United States Patent [19]

Costa

[11] 4,189,135

[45] Feb. 19, 1980

[54] SHEET FEEDER FOR A WRITING SYSTEM

[75] Inventor: Armando Costa, Ivrea, Italy

[73] Assignee: Ing. C. Olivetti & Co., S.p.A., Italy

[21] Appl. No.: 814,136

[22] Filed: Jul. 8, 1977

[30] Foreign Application Priority Data

Sep. 22, 1976 [IT] Italy ..... 69271 A/76

[51] Int. Cl.[2] ..... B65H 3/04; B65H 29/22

[52] U.S. Cl. ..... 271/4; 271/35; 271/186; 400/625

[58] Field of Search ..... 271/4, 3, 5, 6, 7, 186, 271/65, 35; 197/130, 127 R, 127 A; 400/625

[56] References Cited

U.S. PATENT DOCUMENTS

| | | | |
|---|---|---|---|
| 1,836,856 | 12/1931 | Lloyd | 271/186 |
| 2,813,612 | 11/1957 | Berglund et al. | 197/130 |
| 3,140,089 | 7/1964 | Greenblott et al. | 271/5 |
| 3,776,545 | 12/1973 | White | 271/4 |
| 3,840,222 | 10/1974 | Fowlie et al. | 271/4 |
| 4,067,566 | 1/1978 | Williams | 271/6 X |

*Primary Examiner*—Bruce H. Stoner, Jr.

*Attorney, Agent, or Firm*—Schuyler, Birch, McKie & Beckett

[57] ABSTRACT

An automatic sheet feeder, connected to an automatic writing system, for feeding the fresh sheets to a printing station from a first container after a separation in a separate device. After the printing operation, each printed sheet is sent to a driving roller which, in cooperation with a curved guide, reverses the sheet for piling it in a second container positioned above the first container, so that the printed sheets are piled in the same order of printing and upsidedown.

2 Claims, 5 Drawing Figures

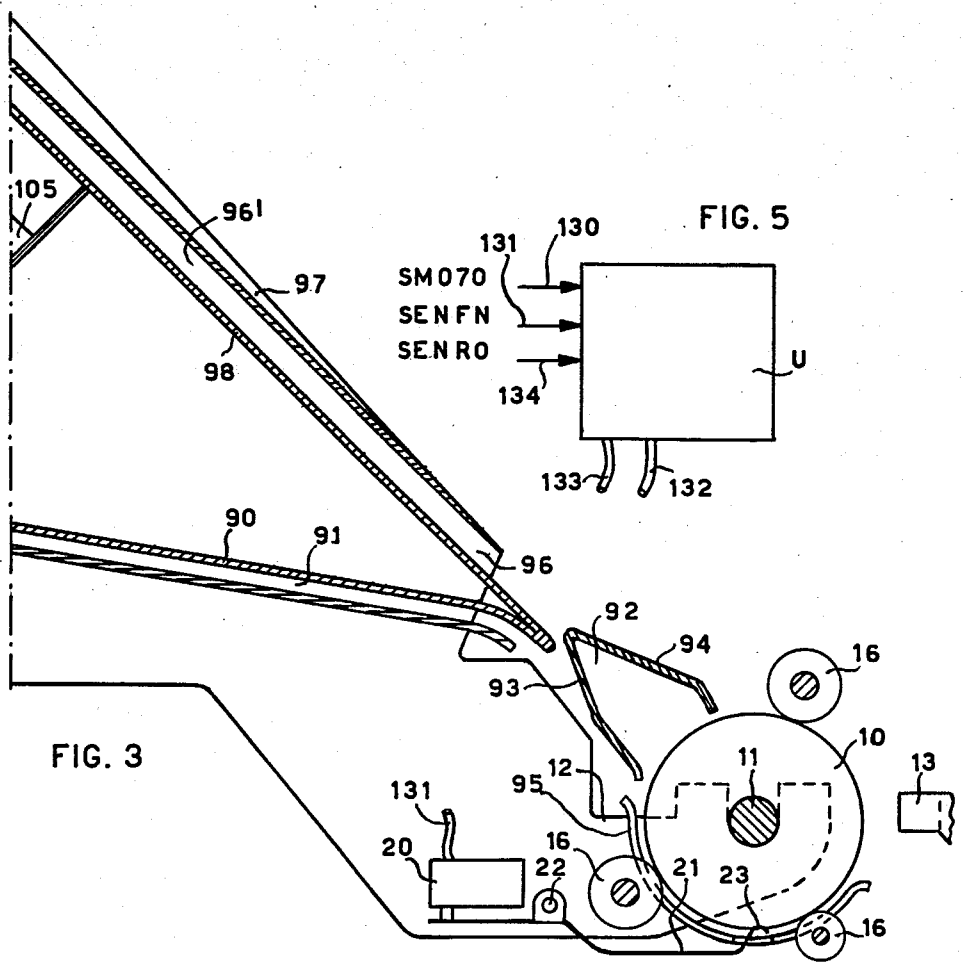
FIG. 5
FIG. 3
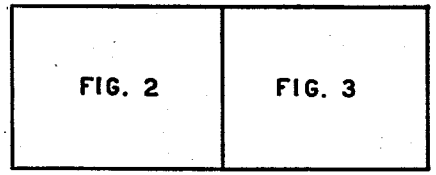
FIG. 4

SHEET FEEDER FOR A WRITING SYSTEM

BACKGROUND OF THE INVENTION

The present invention relates to a sheet feeder for a writing system and similar writing machines and in particular to an automatic sheet feeder connected to a writing system including a platen, a printing station, a control unit for controlling the sheet feeder functions, a first container to contain fresh sheets, a second container to collect the printed sheets, guide means interposed between the first container and the second container, and moving means for driving the sheets along the guide means.

Many different sheet feeding devices for a writing system are well known. In a known type of feeder for writing machines, each single white sheet is sent from the container towards the driving roller through a selector activated by an electromagnet.

Therefore, the sheet passes around the platen and after printing, is driven towards the collecting container, until the driving-rollers pick it up and complete the transport in a direction opposite to the one of feeding.

Each written sheet is laid in the collecting container upon the preceding sheets already written so that at the end of printing the sheets are piled in such a way that the first sheet is under the following ones therefore, with the printed face oriented upwards, whereby the operator has to rearrange the sheets in the right order.

Furthermore, with such a device the driving-roller and the platen are moved by the same motor through a demultiplication gear and a driving-belt.

An electromagnetic clutch separates, selectively, the continuous feeding motor from the intermittent or interline feeding device.

Such a device presents some inconveniences. First of all, the separating device for the sheets to be sent to the platen is noisy and separates with difficulty the sheets stuck together due to electrostatic charges. As already mentioned, the written sheets are laid in the collector in an order contrary to that in which they were written. Furthermore, the feeding and the sheet recovery mechanism uses a completely mechanical transmission which, in addition to being noisy, has a tendency to breakdown.

SUMMARY OF THE INVENTION

According to the present invention, each fresh sheet, drawn from a first container by a sheet separator, is sent to a printing station for the printing operations; then the printed sheet is sent to a reversing device, in which the sheet is reversed and piled in a second container with the printed page set against the support plate of the container.

BRIEF DESCRIPTION OF THE DRAWINGS

The structure and the running of the sheet feeding for a writing system will clearly appear from the following description of a preferred embodiment and the attached drawings, in which:

FIGS. 2 and 3 are a transversal section of the automatic sheet feeder incorporated in the system of FIG. 1;

FIG. 4 is a composition diagram of FIGS. 2 and 3;

FIG. 5 is an outlined description of a central processing unit which governs the sheet feeder.

DETAILED DESCRIPTION OF THE PREFERRED EMBODIMENT

Figure 1:
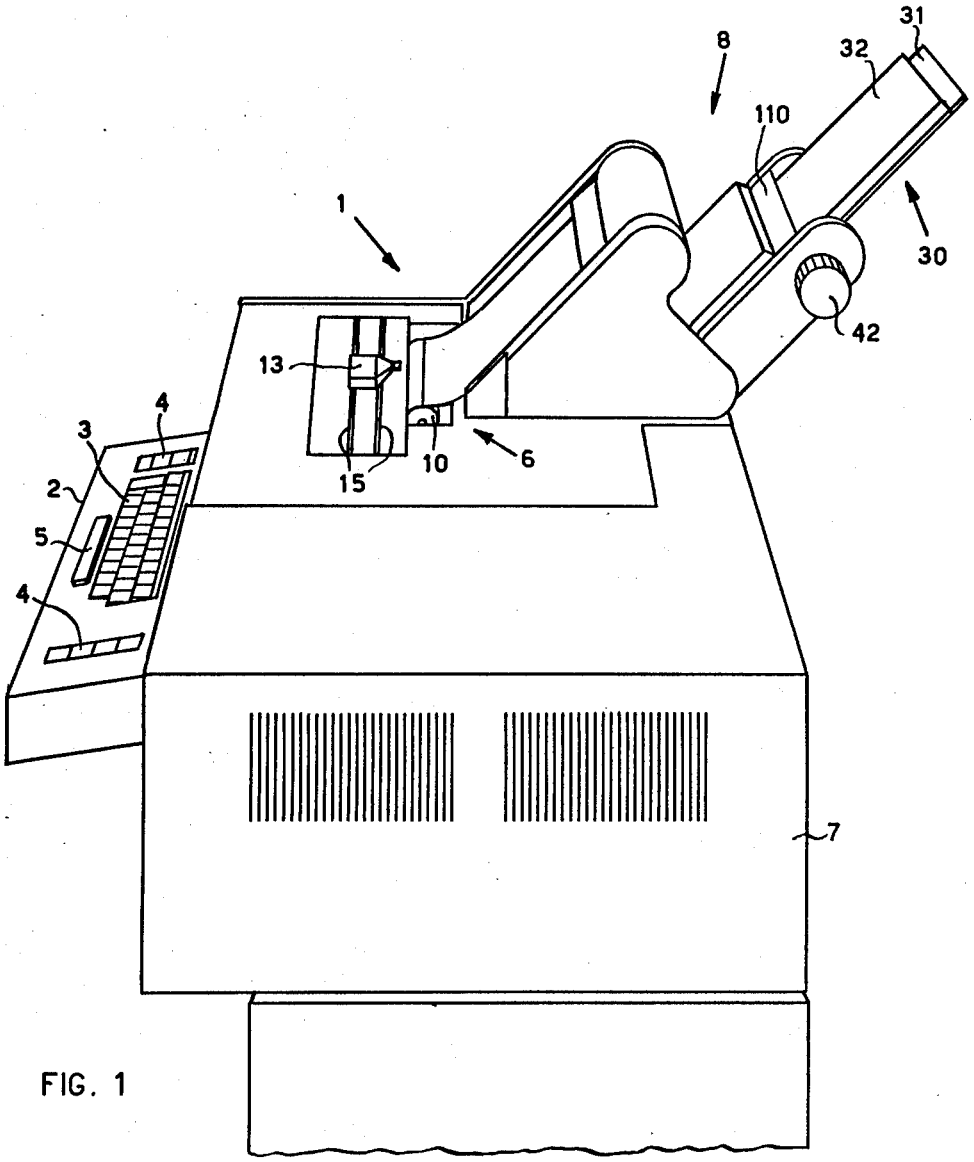
FIG. 1 is perspective description of a writing system incorporating an automatic sheet feeder according to the invention.

With reference to FIG. 1, the writing system is constituted by an operative console 2, an automatic writing machine 6, a casing 7 with electronic devices for data processing, the control and the command of the system functioning by a data processing memory (floppy disk) and by an automatic sheet feeder device 8.

The groups forming the console 2, the writing machine 6 and the casing 7 with electronic devices are not described in detail as they are not part of the present invention and besides they are well known as current state-of-the-art.

A platen 10 (FIGS. 2 and 3) rotates on a shaft 11 revolving about the fixed chassis 12 of the writing machine 6. A wire type writing head 13 is mobile on guides 15 along the roller 10.

Three groups of small pressure rollers 16 assist the roller 10 to permit the sheet transport. A microswitch 20 is actioned by a lever 21 which has its fulcrum over a pivot 22 fixed to the chassis 12.

An extremity 23 of the lever 21 normally interferes with the sheet run on the roller side 10 in such a way that the microswitch 20 is closed when the front edge of a sheet, coming from a new sheet container 30 moves the lever extremity 23. A support plane 31 fixed to the chassis 12 extends itself towards the back part of the sheet feeder 8. A new sheet pad lays frontally against a wall 33 of this support plane 31 fixed to the chassis 12. Mobile arms 40 keyed on a shaft 41 revolving manually on the chassis 12 through a knob 42 external to the feeder 8 extend themselves until they reach the wall 33 and come out from the upper part of the support plane 31.

Figure 2:
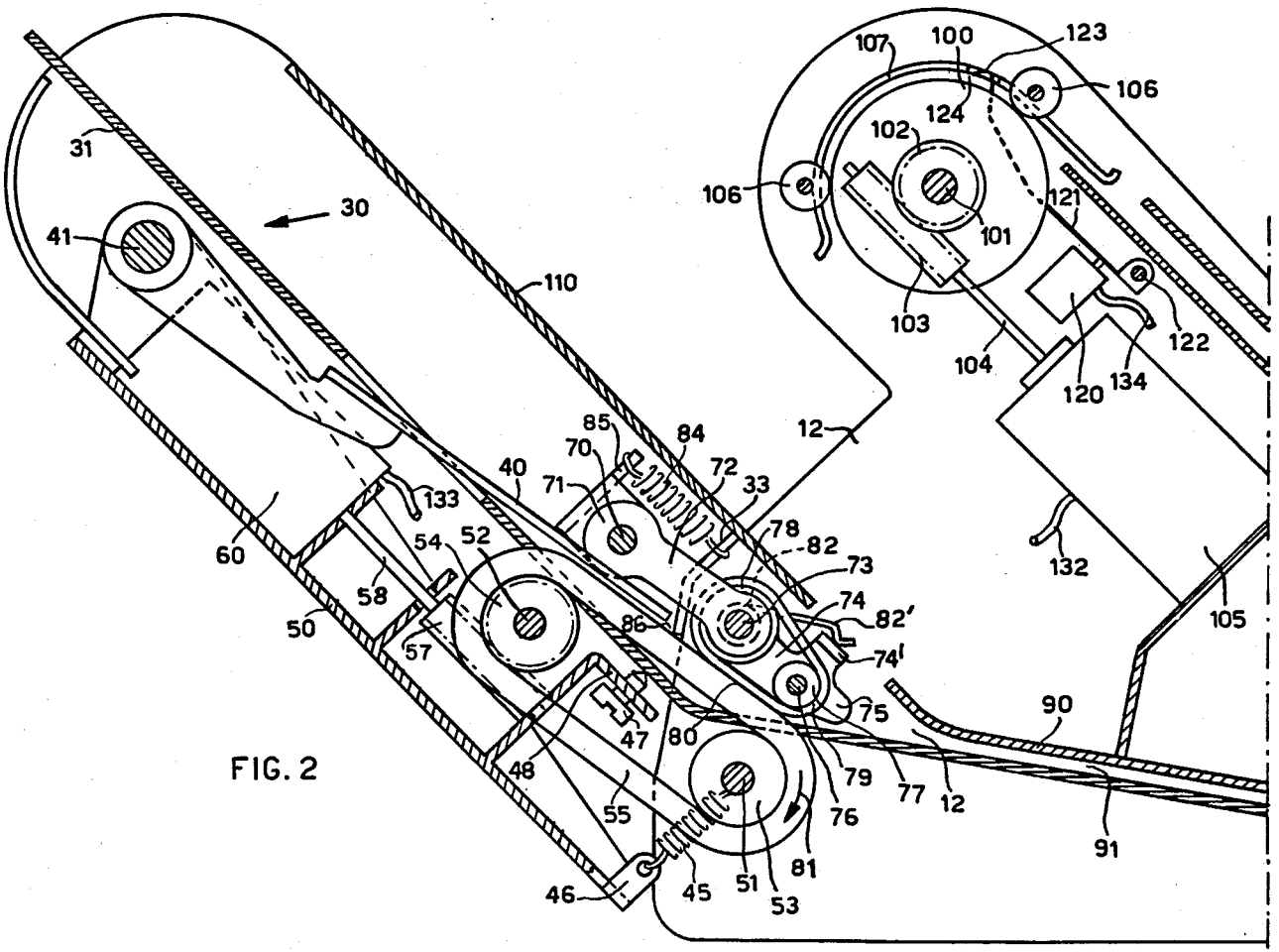

An auxiliary chassis 50 is held in the back part by the shaft 41, and in the front part is supported in its steady position, as shown in FIG. 2 by the action of a spring 45 connected between the front extremity 46 of the chassis 50 and a shaft 51, rotatable on the chassis 12 and parallel to the printing platen 10. Screwed in a tab 48 jointed to the auxiliary chassis 50, a regulated screw 47 points on the lower part of the support plane 31 and regulates the relative position of the chassis 50 as regards the chassis 12.

A shaft 52 parallel to the shaft 51 revolves on the auxiliary chassis 50. Two pulleys 53, 54 on which a soft rubber belt 55 wraps itself are keyed on the shafts 51, 52. A helicoidal, toothed wheel keyed on the shaft 52, meshes with an endless screw 57 fixed on a shaft 58 of an electrical motor 60 fixed on the auxiliary chassis 50.

On a shaft 70 fixed to the chassis 12 a bail 71 is able to swing. On its arms 72 a pivot 73 is fixed. A pulley 78 is fixed on the pivot 73. A belt with a rubber ring 79 is wrapped around the pulleys 77 and 78. The belts 55 and 79 are tangential along a short arc 80. The wheel belt 55 is moved by the motor 60 in direction of the arrow 81 while the belt 79 is maintained steady by the pulley 78 on which this belt is wrapped. A helicoidal, pre-loaded spring 82 wrapped on a pivot 73 has one extremity 82' pressed against the cross-bar 74' of the bail 74 and the other extremity fixed to the shaft 70. The action of the spring 82 tends to rotate the bail 74 clockwise in respect to the pivot 73 pressing the belt 79 against the belt 55. Between the cross-bar 85 of the bail 71, and the wall 33 a spring 84 is held in such a way that the bail 71 is constrained to rotate clockwise in respect to the shaft 70.

The mobile belt 55 together with the steady belt 79 constitute a sheet separating device, the working of which is as follows: sheets of the new sheet pad 32, laid on the support plane 31 slip themselves in the cleft 86 between the wall 33 and the belt 55. When the motor 60 puts the belt 55 into rotation, the sheets after the first pulley beyond the slot 86 are retained by the belt 79.

The material which constitutes the belt 55 has a friction coefficient superior to that of the sheet-to-sheet coefficient while that of the belt 79 is intermediate between the coefficient of the belt 55 and the sheet-to-sheet coefficient.

The support plane 31 extends itself towards the platen 10 forming a conduit jointly with the parallel side 90 which leads near a wedge deviator 92. Through the lower face 93, the deviator forwards the sheet which will insert itself through the roller 10 and the back pressure roller 16 guided by the shield 95. As the operation proceeds, the sheet is driven towards the slot 96 of an upper canal 96', formed by two flat sides 97 and 98 guided by an upper face 94 of the wedge 92. The canal 96' leads near an upper roller 10Q revolving on a shaft 101 fixed to the chassis 12.

A helecoidal toothed pulley 102 which meshes with an endless screw 103 keyed on a shaft 104 of an electrical motor 105 fixed to the chassis 12 is also keyed to the shaft 101. Two small pressure rollers 106 interfere with the upper roller 100, in union with the shield 107 to deviate the reversed sheet towards the bottom and make it fall upside down on the reversing plane 110 between the roller 100 and the support plane 31.

In this way, the written sheets are reversed with the front toward the bottom and each written sheet is deposited on top of the preceding one upsidedown.

A microswitch 120 is actuated by a lever 121 attached at one extremity to the pivot 122 fixed to the chassis 12. The other extremity 123 of the lever 121 interferes with the sheet's course just after the first of the rollers 106, coming out from a slot 124 of the shield 107.

A control unit U (FIG. 5) is a known type of logic unit containing a combinatorial circuit formed by a group of NAND gates and of monostable circuits of the type described in the book "Logic Design and Integrated Circuits" by William E. Wickes, published by John Wiley and sons Inc., New York, Copyright 1968, 68-21185.

The structure of the control unit U is not described in detail as it is beyond the aim of the present invention: for purposes of completeness, we only point out that the control unit U permits two types of operations:

(A) recovery of a sheet if present in the platen (B) recovery of a sheet if present in the platen and feeding of a new sheet.

In case (A) the central unit contained in the casing 7—which is not described as it is a known type and as it does not concern the aim of the present invention—sends on a wire 130 to the control unit U a command SM070 for sheet recovery.

If the microswitch 20 is closed because of the presence of a sheet on the platen, this microswitch 20 allows the control unit U with a logic signal SENFN=1 on wire 131 to start the motor 105 sending the current on wire 132 in such a way that as soon as the sheet coming from the roller 10 in the canal 96' finds itself between the roller 100 and the small roller 106 it is reversed and sent upsidedown on the recuperating plane 110. During the period in which the reversed sheet occupies the stretch included between the two small rollers 106 the microswitch 120 sends on a wire 134 to the control unit U a signal SENRO=1 in order to signal that the reversing phase is in course.

As soon as the sheet frees the lever 121, the microswitch 120 allows the control unit U to stop the motor 105.

In case (B) if one sheet is present in the roller 10, SENFN=1, the control unit U starts the motor 105 to reverse the sheet.

In the same way as described in case (A), and as soon as the microswitch 20 opens itself SENFN goes to zero, the control unit U starts the motor 60 of the sheet separator, sending current on a wire 133 and a new sheet is sent towards the roller 10 in the canal 91.

As soon as the new sheet intercepts the lever 21, the microswitch 20 opens itself and the control unit U stops the motor 60. Simultaneously, the preceding sheet has already completed the reversing phase and the microswitch 120 opens itself to allow the control unit U to stop the motor 105.

Should a clogging of a sheet happen during the transfer, a monostable clock circuit will stop the cycle and signal the breakdown in one of the known types of breakdown signalling techniques.

It is intended that variations, additions and substitutions of parts may be brought to the invention as described without going beyond the limits of the invention.

What I claim is:

1. In an automatic writing system including a frame, a cylindrical platen rotatably mounted on said frame, a printing station, an operative console, and a data processing central unit, an automatic sheet feeder comprising:

a control unit for controlling the sheet feeder functions;

a first container, fixed to said frame, for containing fresh sheets;

a second container, fixed to said frame, parallel to and located above said first container for collecting the printed sheets;

guiding means for guiding the sheets from said first container to said second container, said guiding means comprising a first pair of parallel spaced apart plates connected to said frame for guiding the fresh sheets from said first container to said printing station, a second pair of parallel spaced apart plates connected to said frame for guiding said printed sheets from the printing station towards said second container, an upper driving roller rotatably mounted on said frame between said second pair of plates and said second container for driving said printed sheets, an arcuate shield having its concavity directed towards said second container and being partially wrapped around said upper roller, and a wedge deviator in an upper position with respect to said platen cooperating with said first and second pairs of plates for guiding the fresh sheets from said first pair of plates to said printing station and for guiding the printed sheets from said printing station to said second pair of plates;

a rotational power source selectively operable by said control unit and mechanically linked to said upper roller for driving the printed sheets from said arcuate shield and for piling them into said second container in reversed position with their printed faces in the same order of printing; and a sheet separator located between said first container and said first pair of plates for supplying to the printing station only one sheet at a time, said sheet separator comprising:

a support pivotally connected to said frame and located under said first container, a first pulley rotatably mounted on said support and a second pulley rotatably mounted on said frame, a closed loop belt wound around said pulleys, a motor mounted on said support and mechanically linked to said first pulley and selectively operated by said control unit for rotating said pulley, an annular belt located with respect to and partially overlying said closed loop belt, supporting means connected to said frame for supporting said annular belt and spring means connected between said support and said frame to urge said closed belt against said annular belt.

2. An automatic sheet feeder as set forth in claim 1, wherein said supporting means comprises:

a bridge lever pivotally connected to said frame;

a first cylindrical element fixed on a pin at one end of said lever;

a bail pivotally connected on said pin;

a second cylindrical element fixed on said bail, said annular belt being wound around said first and second cylindrical elements; and resilient means acting against said bridge lever and said bail in opposition to the thrust of said spring means.

* * * * *